United States Patent [19]

Aubel et al.

[11] 4,089,622

[45] May 16, 1978

[54] VACUUM GENERATOR

[75] Inventors: John Anton Aubel; Clarence Dennis Fox, both of Decatur, Ill.

[73] Assignee: Borg-Warner Corporation, Chicago, Ill.

[21] Appl. No.: 698,572

[22] Filed: Jun. 22, 1976

[51] Int. Cl.[2] ..... F04F 5/52

[52] U.S. Cl. ..... 417/188; 417/189

[58] Field of Search ..... 417/76, 87, 187, 188, 417/189; 251/61.4, 214; 303/12; 60/397, 407, 409

[56] References Cited

U.S. PATENT DOCUMENTS

| | | | |
|---|---|---|---|
| 1,159,957 | 11/1915 | Kneass | 417/188 |
| 1,180,017 | 4/1916 | Davenport | 417/188 X |
| 1,441,651 | 1/1923 | Anderson et al. | 417/189 |
| 2,340,671 | 2/1944 | Lingenbrink | 417/189 X |
| 2,765,185 | 10/1956 | Mott | 251/214 X |
| 3,435,841 | 4/1969 | Williams et al. | 417/189 X |
| 3,593,958 | 7/1971 | Mueller | 251/61.4 |

*Primary Examiner*—William L. Freeh
*Assistant Examiner*—Edward Look
*Attorney, Agent, or Firm*—Herman E. Smith

[57] ABSTRACT

A vacuum generator of the ejector type includes a control valve subjected to frictional damping forces wherein the frictional damping forces are varied in response to changes in pressure differentials in the device such that the control valve is enabled to move quickly between opened and closed conditions thereby avoiding throttling of the motive fluid.

1 Claim, 4 Drawing Figures

VACUUM GENERATOR

BACKGROUND OF THE INVENTION

1. Field

The present invention relates to vacuum generators of the type in which a motive fluid flowing through an ejector pump creates a vacuum. More particularly the invention relates to valve means for controlling the flow of motive fluid in such a vacuum generator.

2. Prior Art

It is known to produce a vacuum by means of a motive fluid flowing through an ejector pump and to control the flow of motive fluid by means of valve which may be operable in response to a condition. For example, the vacuum condition produced by the ejector pump may be applied to an expansible chamber valve operator for controlling movement of a valve which in turn control the flow of motive fluid, Such devices tend to reach a stable operating condition in which the vacuum produced by the ejector pump holds the control valve in a partially open condition which permits sufficient flow of motive fluid to maintain the vacuum condition. Where motive fluid flows through a partially open valve, a portion of the available energy of the motive fluid is lost in overcoming flow resistance in the valve whereas it would be desirable to make full use of the available energy of the motive fluid. To this end it has been suggested to provide a valve operator means which moves the control valve between open and closed positions in order to reduce the losses arising from flow through the valve. For example, it has been suggested to provide a lost motion valve operator means for this purpose. Such devices are often complicated in structural organization and occupy considerable space. As a result, improvements in means for controlling the flow of motive fluid are desirable, particularly improvements which would result in a simpler more compact structural organization.

SUMMARY OF THE INVENTION

The present invention relates to improvements in vacuum generators of the type which employs flow of motive fluid through an ejector pump, and more particularly relates to improvements in controlling the flow of the motive fluid therein. It is an object of the present invention to provide valve means for controlling the flow of motive fluid in a vacuum generator wherein hysteresis is imposed upon a valve member for modifying its response to a control condition. It is a further object of the invention to employ the pressure of motive fluid in combination with a pressure responsive friction device for imposing a frictional retarding force on a valve member movable for controlling the flow of the motive fluid.

DESCRIPTION OF THE PREFERRED EMBODIMENT

Figure 1:
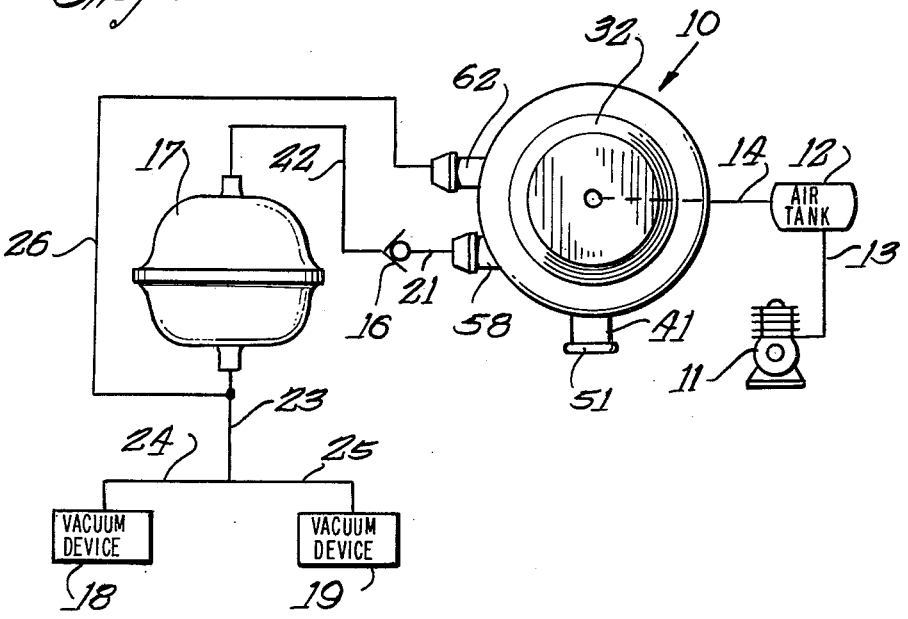
FIG. 1 is a schematic representation of a pneumatic circuit including a vacuum generator.

Referring now in more detail to the drawings, a vacuum system is shown schematically in FIG. 1 including a vacuum generator 10 connected to a motive fluid circuit and to a vacuum circuit. The motive fluid circuit is indicated schematically by air compressor 11, compressed air storage tank 12 and connecting conduits 13, 14 arranged for supplying air under pressure to the vacuum generator. The vacuum circuit is indicated schematically by check valve 16, vacuum canister or reservoir 17, vacuum operated devices 18, 19 and connecting conduits 21, 22, 23, 24, 25. A feedback conduit 26 is connected between the vacuum circuit and a control portion of vacuum generator 10 such that the vacuum level in the vacuum circuit may be employed for controlling operation of the vacuum generator.

Figure 2:
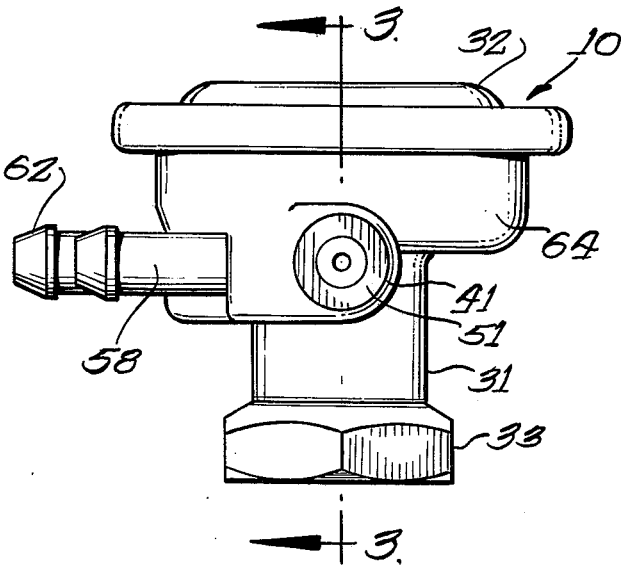
FIG. 2 is an elevation view of a vacuum generator according to the present invention.
Figure 3:
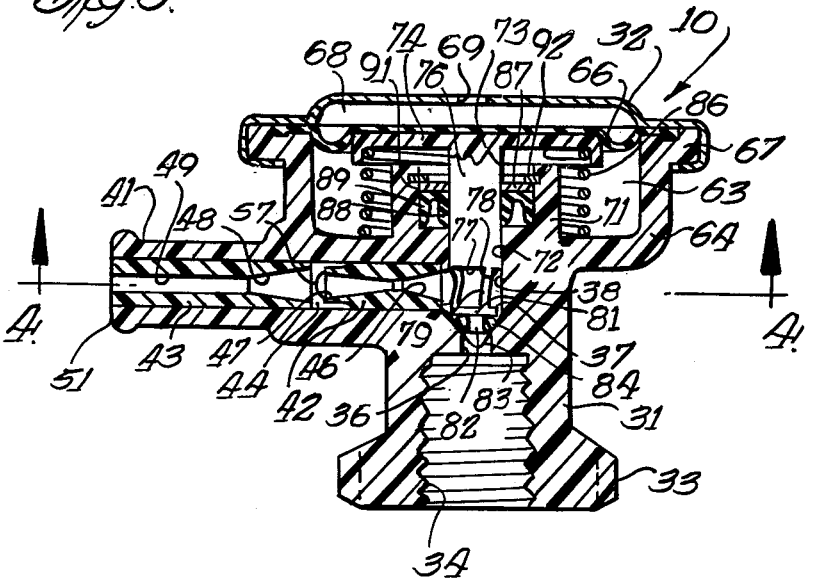
FIG. 3 is a section view taken along the line 3—3 of FIG. 2.
Figure 4:
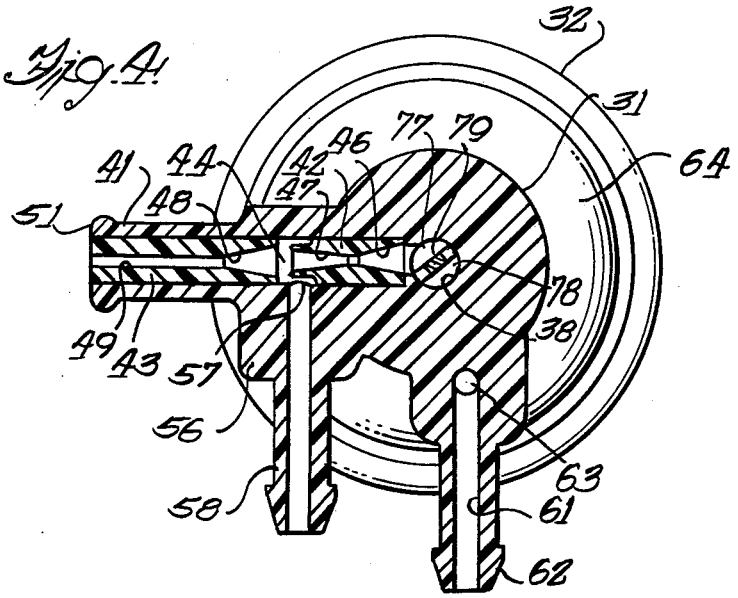
FIG. 4 is a section view taken along the line 4—4 of FIG. 3.

The vacuum generator 10 is shown to enlarged scale in FIGS. 2, 3 and 4 and includes a body 31 and a cover 32. Body 31 includes an inlet portion 33 having an internally threaded opening 34 to facilitate connection to a source of motive fluid such as conduit 14. An inlet port 36 extends from opening 34 to a valve seat 36 which communicates with an internal passage 38. Body 31 also includes an exhaust portion 41 which receives an ejector nozzle 42 and an exhaust nozzle 43 spaced from each other to define a vacuum cavity 44, ejector nozzle 42 being in fluid communication with passage 38, and arranged to conduct the flow of motive fluid from passage 38 toward cavity 44 and exhaust nozzle 43. Ejector nozzle 42 includes a converging inlet 46 and a diverging outlet 47 arranged for transforming the energy of fluid pressure into fluid velocity. Exhaust nozzle 43 includes a converging inlet 48 joining an outlet portion 49 which communicates with atmosphere through an end surface 51 of exhaust portion 41. The ejector nozzle 42, vacuum cavity 44 and exhaust nozzle 43 are arranged to form an ejector pump for producing a vacuum in cavity 44. Ejector pump apparatus is known in the prior art, and therefore an extensive description of such devices is believed unnecessary.

A vacuum portion 56 of body 31 includes a vacuum port 57 communicating with vacuum cavity 44 and extending through a tube connector portion 58. The configuration of tube connector portion 58 is selected for facilitating connection to a flexible tube indicated schematically by reference character 21 of FIG. 1.

A control port 61 is formed in body 31 and is arranged to provide communication between a tube connector portion 62 and a control chamber 63 which is also formed in body 31. The control chamber 63 is defined in part by a cup-like portion 64 of body 31 and by a diaphragm 66 secured to a rim portion 67 of the body by the cover 32. An atmospheric chamber 68 is formed between diaphragm 66 and cover 32 and communicates with atmosphere through aperture 69.

An annular boss portion 71 is formed in body 31 so as to extend within control chamber 63. A bore 72 is formed in boss 71 which terminates in passage 38 and valve seat 37.

A valve member 73 includes a plate portion 74 engaging diaphragm 66 and a depending stem portion 76 slideable in bore 72 for movement toward and from valve seat 37. Stem portion 76 includes supplemental lift surfaces 77, 78 exposed to passage 38. A web portion 79 extends from supplemental surfaces 77, 78 and terminates in a flange 81, groove 82 and nose 83. An O-ring seal 84 is mounted in groove 82 arranged for sealing engagement with valve seat 37.

A bias spring 86 is seated in cup-like portion 64 and engages plate portion 74 urging valve 73 upwardly as viewed in FIG. 3 so as to urge O-ring 84 away from engagement with valve seat 37.

A pressure responsive frictional damping device 87 is provided in the form of an annular rubber-like U-shaped seal including inner 88 and outer 89 sealing lips and a backing ring 91. Damping device 87 is secured in annular boss 71 by means of a retaining ring 92.

The operation of vacuum generator 10 will now be described with particular reference to FIGS. 3 and 4 assuming that the generator has been connected in a system as shown in FIG. 1, that is, that a source of compressed air is available to inlet port 36, that vacuum port 57 is connected to a vacuum circuit and that a vacuum feedback signal is present in control chamber 63 through control port 61.

In the position shown in FIG. 3 wherein valve 73 closes valve seat 37, the forces acting on the valve are as follows. The pressure of the compressed air (motive fluid) acts on nose 83 urging the valve away from seat 37, atmospheric pressure is present in the ejector pump and passage 38 where it acts on supplemental surfaces 77, 78 and also on inner lip 88 by means of leakage between stem 76 and bore 72 thereby pressing inner lip 88 against stem 76 to provide a frictional holding force opposing sliding movement of the valve stem, spring 86 exerts a force tenting to urge the valve away from seat 37, these forces are opposed by the sub-atmospheric vacuum depression present in control chamber 63 which in combination with atmospheric pressure present in atmospheric chamber 68 act to maintain the valve in engagement ewith seat 37.

For purposes of illustration assume that a vacuum depression of fifteen inches of mercury in control chamber 63 is sufficient to hold valve 73 in engagement with seat 37. If the vacuum depression in control chamber 63 is weakened, the air pressure in inlet port 36 acts on nose 83 providing an initial increment of movement of the valve away from seat 37 thereby admitting motive fluid under pressure to passage 38 where the motive fluid acts on supplemental surfaces 77, 78 causing the valve to slide quickly in bore 72 against the friction of lip 88 to a fully open position. When the valve is moved away from the seal, the leakage path between stem 76 and bore 72 is reduced in length at the same time the pressure in chamber 38 is increased with the result that a greater pressure is then applied to lip 88 to increase the frictional holding force on stem 76. When the valve is open (away from seat 37) the motive fluid flows to atmosphere through the ejector pump apparatus thereby increasing the vacuum depression in port 57 which is trapped in reservoir 17 behind check valve 16. The increased vacuum depression is fed back to control chamber 63 where it results in an increased pressure difference with respect to atmosphere across diaphragm 66 tending to close the valve and simultaneously increases the pressure difference with respect to the motive fluid across lip 88 thereby increasing the frictional force on stem 76 tending to hold the stem in open position away from check valve seat 37.

At some increased level of vacuum depression, for example, twenty one inches of mercury, the pressure differential across diaphragm 66 is sufficiently strong to slide valve 73 to closure with seat 37 against the force of friction provided by lip 88 and against the bias of spring 86 and the pressure of motive fluid acting on supplemental surfaces 77, 78. As soon as the valve is closed against seat 37, the pressure in passage 38 returns to atmospheric which relieves the pressure acting on supplemental surfaces 77, 78 and at the same time reduces the pressure differential across lip 88 and consequently reduces the frictional damping force exerted on stem 76 by lip 88. As the vacuum depression in chambr 63 is reduced, the pressure differences across lip 88 is reduced, further reducing the frictional holding force on the stem until at some level, for example, 15 inches of mercury, the valve is again allowed to move to open position for replenishing the vacuum level.

It is to be understood that the above description of the operation of the vacuum generator is exemplary inasmuch as the specifics of operation in any particular case will be determined by the areas of surfaces in combination with the available pressure of motive fluid and the desired level of vacuum depression.

What is claimed is:

1. A vacuum generator comprising a body, including an inlet port adapted for communication with a source of motive fluid, a passage, a valve seat disposed in said passage, ejector means communicating with said passage, a vacuum port communicating with said ejector means, a fluid control chamber adjacent said passage including valve operator means, a valve member extending between said control chamber and said passage, said valve member being connected to said valve operator means and mounted in said body for sliding movement toward and from closure with said valve seat in response to movement of said valve operator means, and a pressure responsive friction damping device frictionally engaging said valve member and communicating with said passage, said friction responsive damping device including a resilient lip embracing a stem portion of said valve member, said lip being in fluid communication with said passage, said lip exerting increased resistance to movement of said valve stem while motive fluid is present in said passage.

* * * * *